US006931892B2

(12) United States Patent
Lee

(10) Patent No.: US 6,931,892 B2
(45) Date of Patent: Aug. 23, 2005

(54) DRAINAGE CONTROL DEVICE FOR WASHING MACHINES

(75) Inventor: Hong-Yeol Lee, Yongin (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 656 days.

(21) Appl. No.: 09/802,989

(22) Filed: Mar. 12, 2001

(65) Prior Publication Data

US 2002/0033032 A1 Mar. 21, 2002

(30) Foreign Application Priority Data

Sep. 20, 2000 (KR) ..... 2000-55267

(51) Int. Cl.[7] ..... D06F 39/08
(52) U.S. Cl. ..... 68/12.14; 68/208; 60/527
(58) Field of Search ..... 68/208, 12.02, 68/12.12, 12.14, 12.19, 207; 60/527

(56) References Cited

U.S. PATENT DOCUMENTS 3,132,472 A * 5/1964 Schweitzer ..... 60/531
3,662,734 A * 5/1972 Sisler ..... 125/16.01
3,665,705 A * 5/1972 Christensen ..... 60/527
3,782,121 A * 1/1974 Marcoux et al. ..... 60/527
3,976,244 A * 8/1976 Logsdon ..... 236/49.5
4,209,989 A * 7/1980 Andresen ..... 60/527
4,726,283 A * 2/1988 Miyamoto ..... 92/110
4,945,727 A * 8/1990 Whitehead et al. ..... 60/527
5,738,658 A * 4/1998 Maus et al. ..... 604/151
5,971,288 A * 10/1999 Davis et al. ..... 236/68 R
6,347,645 B2 * 2/2002 Gurubatham et al. ..... 137/831

FOREIGN PATENT DOCUMENTS

FR 2015390 * 8/1990
GB 2048090 * 12/1980
GB 2171517 * 8/1986
JP 200-084289 3/2000

* cited by examiner

*Primary Examiner*—Frankie L. Stinson
(74) *Attorney, Agent, or Firm*—Stites & Harbison PLLC; Douglas E. Jackson

(57) ABSTRACT

A drainage control device for washing machines is disclosed. This device controls the drain port, provided at the bottom of a washing tub, thus draining water from the washing tub in accordance with an operational mode of a washing machine. This drainage control device includes a first drive means containing a working fluid and operated in response to a change in volume of the working fluid, and a second drive means connected to the first drive means and controlling inflow and outflow of the working fluid relative to the first drive means. The first drive means comprises a first cylinder containing the working fluid, a first piston reciprocating within the first cylinder, a heating means used for heating the first piston, and an actuation rod operated in conjunction with both the first piston and the heating means to open or close the drain port. This device is less likely to cause operational errors or operational noises regardless of long periods of use, and also has a simple construction, a reduced number of parts, and is produced at low cost due to the simple construction.

6 Claims, 6 Drawing Sheets

DRAINAGE CONTROL DEVICE FOR WASHING MACHINES

BACKGROUND OF THE INVENTION

1. Field of the Invention

The present invention relates to drive devices and, more particularly, to a drive device including both a first drive means, containing a working fluid and operated in response to a change in volume of the working fluid, and a second drive means connected to the first drive means and controlling inflow and outflow of the working fluid relative to the first drive means.

2. Description of the Prior Art

The present invention, relating to a drive device, will be described in detail in conjunction with a drainage control device for washing machines, as an example.

As shown in FIG. 1, a conventional washing machine includes a drive motor 3. This motor 3 is installed within the lower chamber of the washing machine's cabinet at a position below a washing tub 1, and generates drive force for the tub 1. A power transmission unit 2 connects the drive motor 3 to the washing tub 1, and transmits the drive force of the motor 3 to the tub 1. A drain port 4*a* is provided on the bottom of the washing tub 1 at a position spaced apart from the power transmission unit 2. A drain hose 4 extends from the drain port 4*a* to the outside of the cabinet. The washing machine also has a drainage control device used for controlling the drain port 4*a* to discharge water from the washing tub 1, in addition to controlling the power transmitting operation of the power transmission unit 2. This drainage control device comprises a drain motor 5. This drain motor 5 is installed at a predetermined position spaced apart from both the power transmission unit 2 and the drain port 4*a*, and generates drive force for controlling the operation of both the drain port 4*a* and the power transmission unit 2.

A connection bracket 6, with a steel wire 6*a*, connects the drain port 4*a* to the drain motor 5. A brake lever (not shown) is connected to a connection lever 7 of the power transmission unit 2, and so the power transmission unit 2 is operated in conjunction with the drain motor 5. Therefore, both the power transmission unit 2 and the drain port 4*a* are operable in conjunction with the drain motor 5. When the brake lever is actuated in response to a rotation of the drain motor 5, the connection bracket 6 is pulled to open the drain port 4*a*.

When the washing machine is turned on, water is fed into the washing tub 1 to reach a predetermined water level. When water reaches the predetermined water level within the washing tub 1, the pulsator of the tub 1 is rotated in opposite directions by the drive motor 3 to perform a washing mode. After the washing mode is finished, the drain motor 5 is activated to open the drain port 4*a* while controlling the operation of the power transmission unit 2, thus draining water from the washing tub 2 to the outside of the cabinet through the drain hose 4.

However, the drainage control device of the conventional washing machine has the following problems. That is, it is necessary for the drainage control device to include a drain motor 5 having a high power capable of pulling the connection bracket 6 to open the drain port 4*a* and pulling the connection lever 7 of the power transmission unit 2 to release a brake band (not shown) during a draining mode or a dehydrating mode. This drain motor 5 is fabricated with numerous gears 5*a* encased in a motor housing as shown in FIG. 2, and so the motor 5 has a complex construction and undesirably generates operational noise during an operation of the washing machine.

In addition, the gears 5*a* of the drain motor 5 are abraded through long periods of operation to cause operational errors of the motor 5. In the case of operational errors of the motor 5 due to an abrasion of the gears 5*a*, it is almost impossible to selectively replace abraded gears 5*a* with new ones. Accordingly, a user of the washing machine is forced to replace the motor 5 with a new one while paying excessive costs for the replacement. Due to the complex construction and the excessive number of gears 5*a*, the drain motor 5 undesirably increases the manufacturing and assembly cost of the washing machine.

SUMMARY OF THE INVENTION

Accordingly, the present invention has been made keeping in mind the above problems occurring in the prior art, and an object of the present invention is to provide a drainage control device for washing machines, which has a simple construction, a reduced number of parts, and is less likely to cause operational errors or operational noises regardless of long periods of use.

Another object of the present invention is to provide a drainage control device for washing machines, which is produced at low cost due to its simple construction.

In order to accomplish the above objects, the present invention provides a drainage control device for washing machines, comprising a drain hose connected to a drain port which is provided at the bottom of a washing tub, a drain control valve for opening or closing the drain port, a connection bracket connected to the drain control valve, and a driving device for driving the connection bracket, wherein the driving device comprises a first drive means containing a working fluid and operated in response to a change in volume of the working fluid, and a second drive means connected to the first drive means and controlling inflow and outflow of the working fluid relative to the first drive means.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
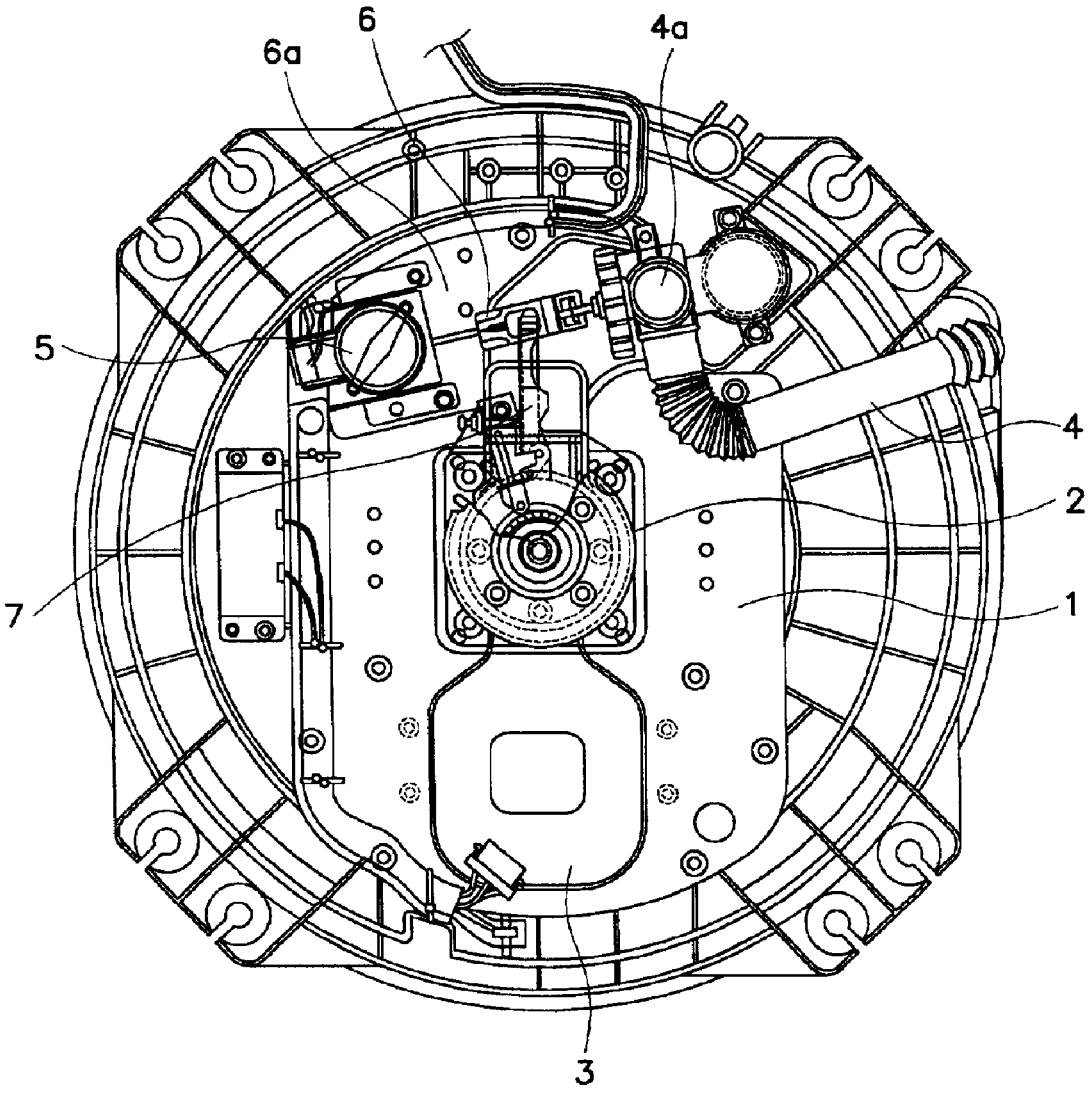
FIG. 1 (PRIOR ART)
FIG. 1 is a bottom view of a washing tub of a conventional washing machine, showing a conventional drainage control device included in the washing machine.
Figure 2:
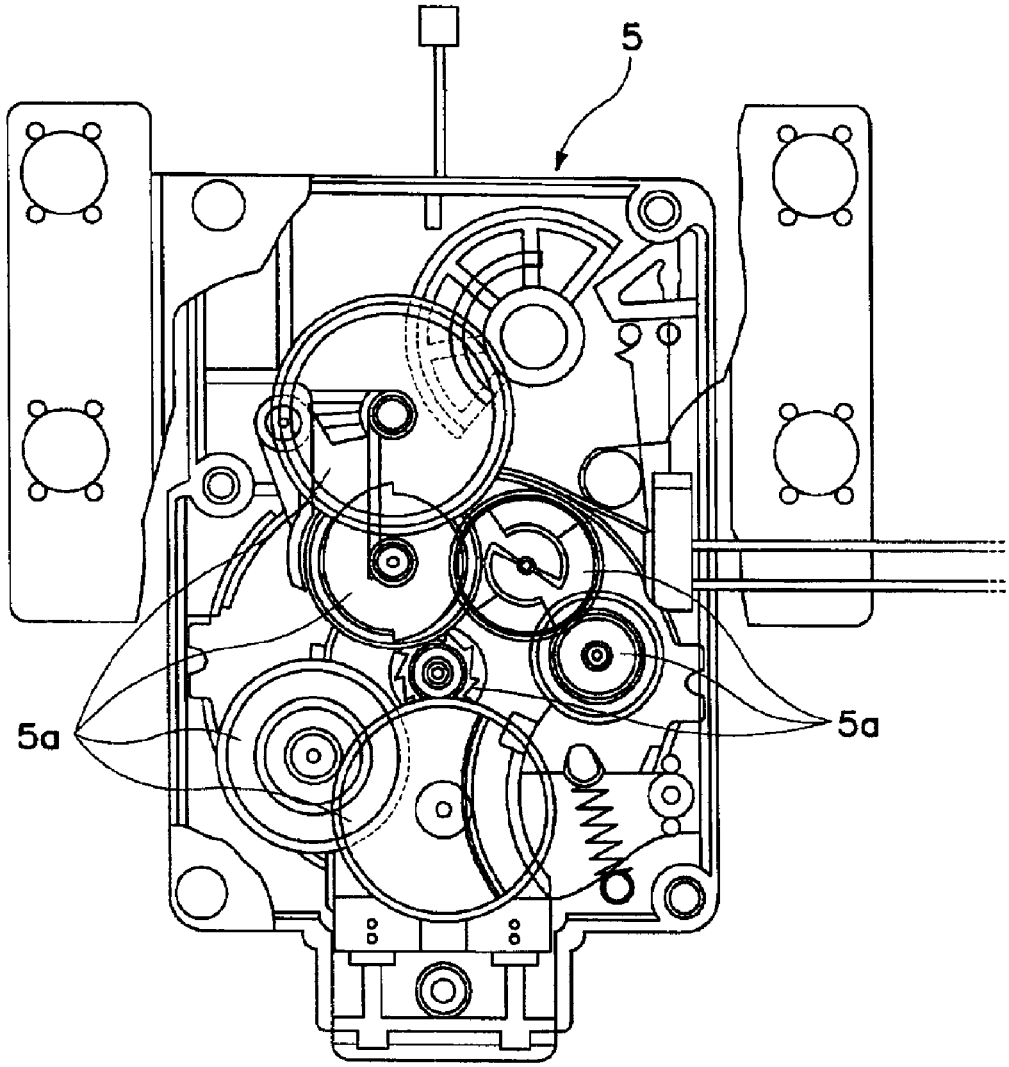
FIG. 2 (PRIOR ART)
FIG. 2 is a side-sectional view of a drain motor included in the conventional drainage control device, showing the construction of the drain motor.

Reference now should be made to the drawings, in which the same reference numerals are used throughout the different drawings to designate the same or similar components.

Figure 3:
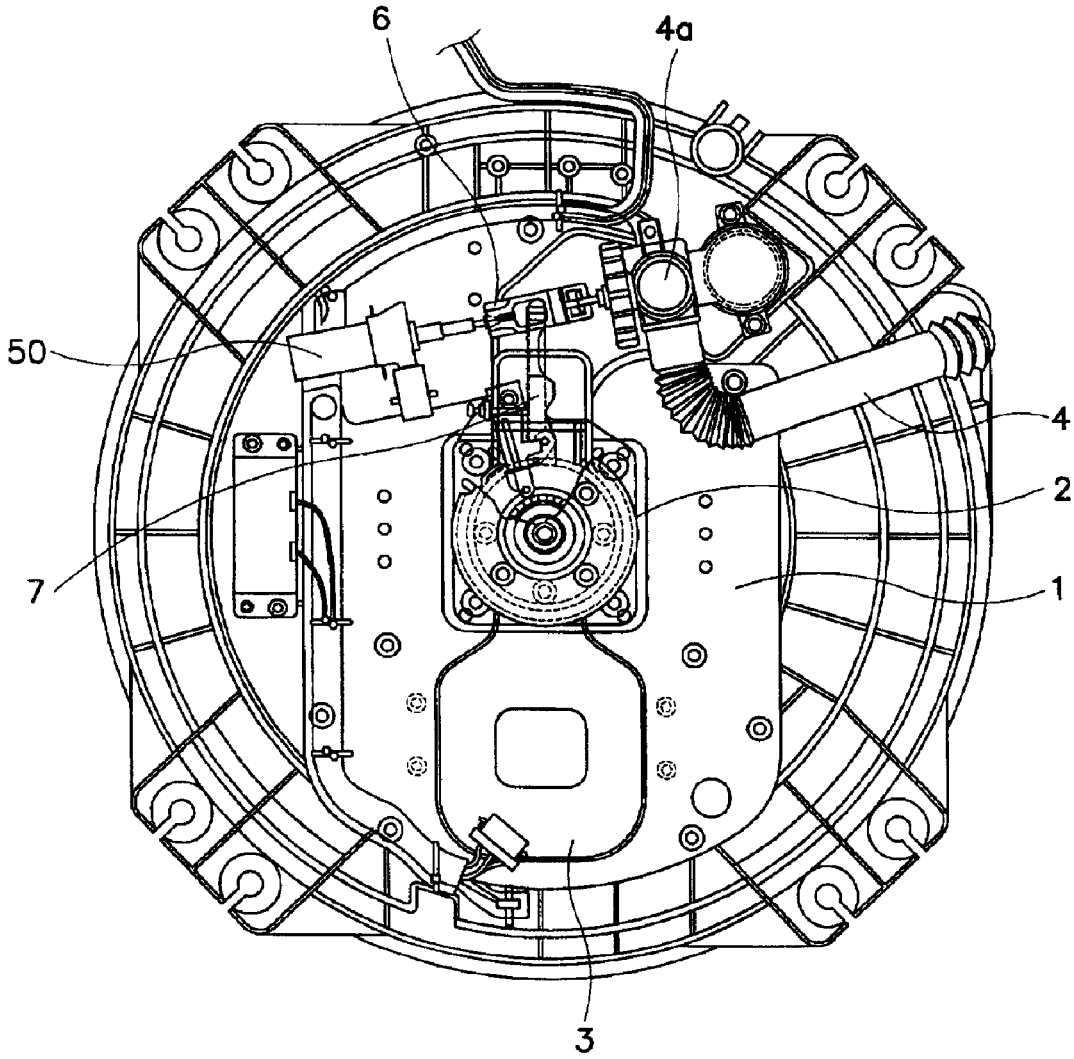
FIG. 3 is a bottom view of a washing tub of a washing machine, showing a drainage control device included in the washing machine in accordance with the preferred embodiment of the present invention.

FIG. 3 is a bottom view of a washing tub of a washing machine, showing a drainage control device included in the washing machine in accordance with the preferred embodiment of the present invention. As shown in the drawing, the washing machine of this invention includes a drive motor 3 and a power transmission unit 2, which are installed at the outer bottom of a washing tub 1, and generates drive force for the tub 1. A drain port 4*a* is provided on the bottom of the washing tub 1 at a position spaced apart from the power transmission unit 2, with a drain hose 4 extending from the drain port 4*a* to the outside of the cabinet. The washing machine also has a drainage control device 50 used for controlling the drain port 4*a* to discharge water from the washing tub 1 as desired, in addition to controlling the power transmitting operation of the power transmission unit 2. This drainage control device 50 is positioned at a predetermined position spaced apart from both the power transmission unit 2 and the drain port 4*a*.

Figure 4:
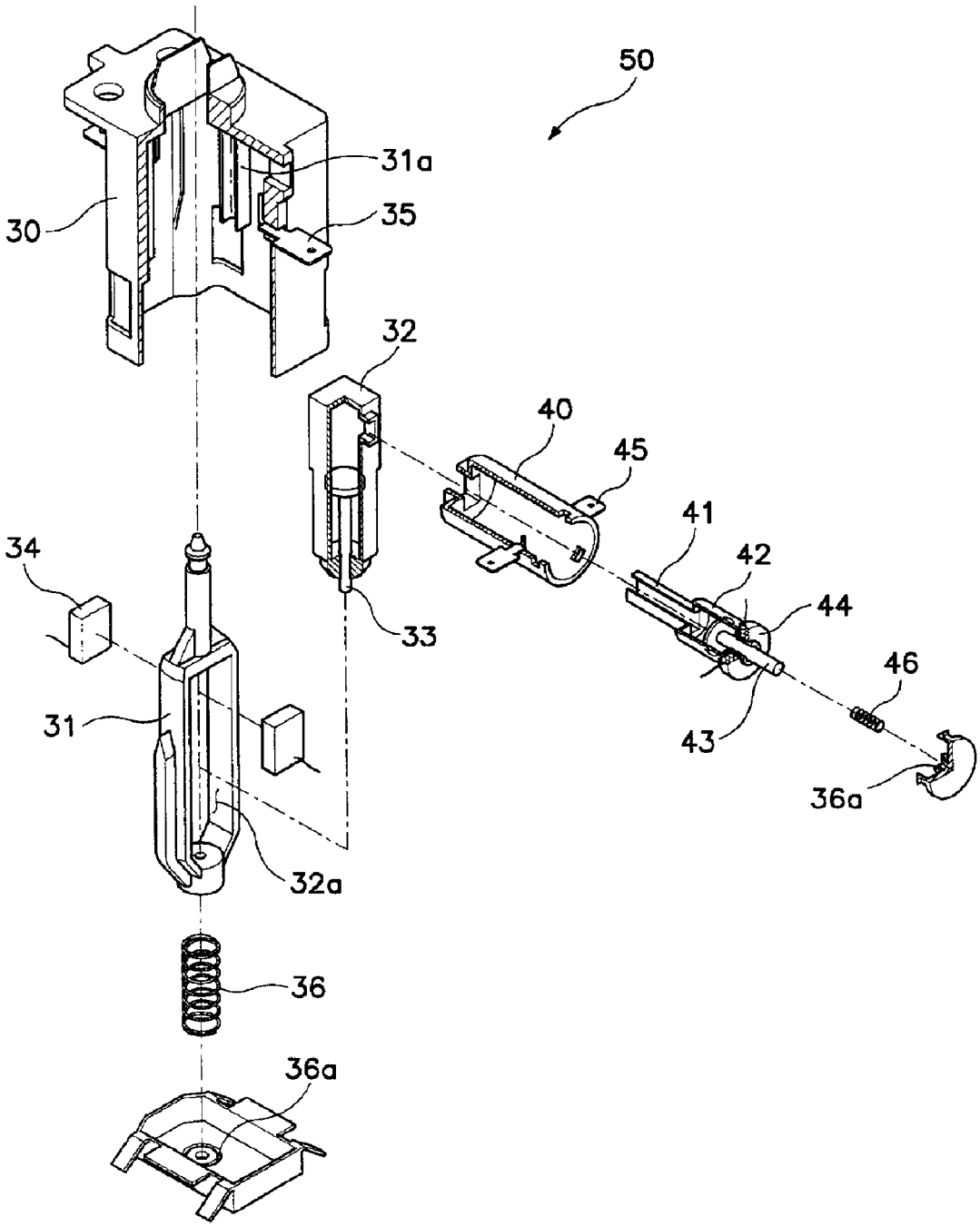
FIG. 4 is an exploded perspective view of the drainage control device of this invention.
Figure 5:
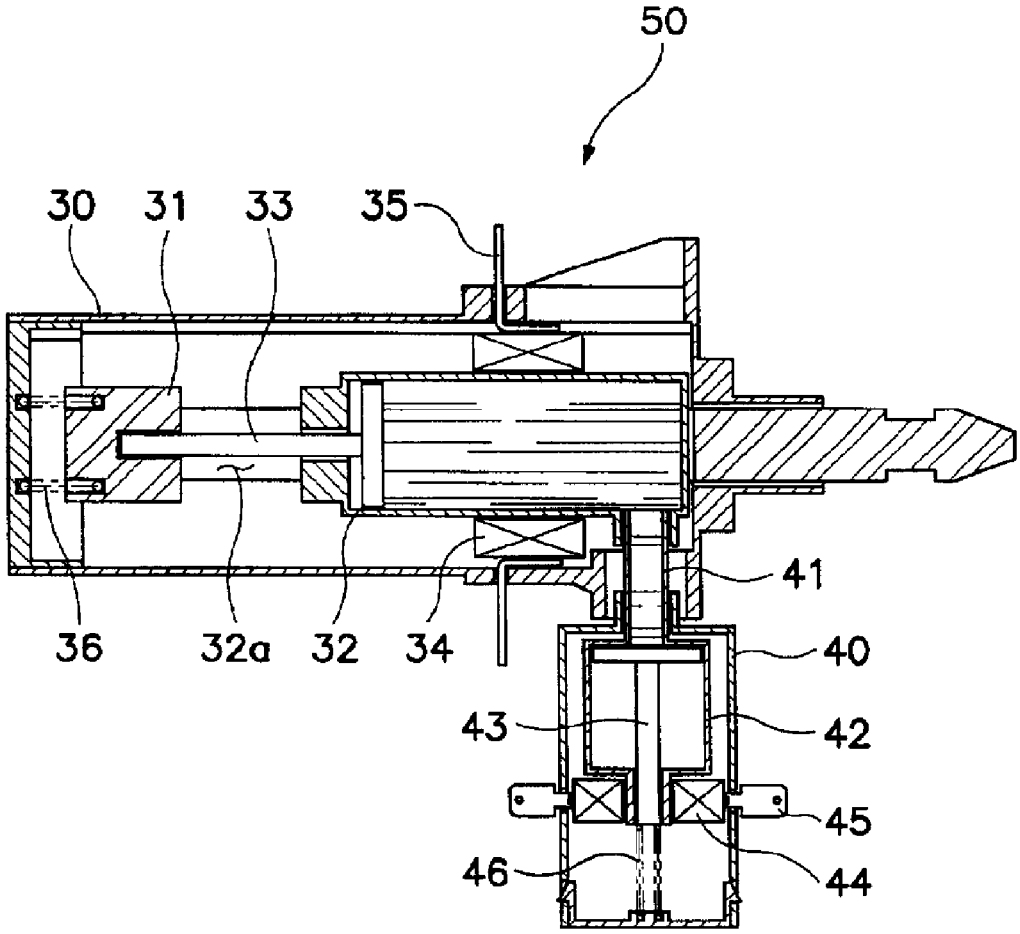
FIG. 5 is a plan view, showing an operation of the drainage control device of this invention during a draining or dehydrating mode of the washing machine.

As shown in FIG. 4 or 5, the drainage control device 50 of this invention comprises a first case 30 and a second case 40. In the drainage control device 50, a first cylinder 32 is encased in the first case 30, while a second cylinder 42 is encased in the second case 40 as will be described in detail later herein. The two cylinders 32 and 42 are communicated together through a pipe 41.

The first case 30 has a box shape with a rectangular cross-section. Two actuation rod guiders 31*a* are axially provided on opposite internal surfaces of the first case 30, and guide a linear movement of an actuation rod 31 within the case 30. The actuation rod 31 is inserted into the first case 30 while movably engaging with the rod guiders 31*a* such that the actuation rod 31 is normally projected from one end of the first case 30 to a desired length.

The actuation rod 31 is connected to a connection bracket 6 at the end projected from the case 30. When the actuation rod 31 of the first case 30 pulls the connection bracket 6, the drain port 4*a* is opened. In addition, the actuation rod 31 also pulls the connection lever 7 of the power transmission unit 2 to release a brake band (not shown) during a draining mode or a dehydrating mode of the washing machine.

A cylinder seat opening 32*a* is formed in the actuation rod 31 at a predetermined position, and sits the first cylinder 32 therein. The first cylinder 32 is made of a highly conductive metal capable of quickly heating the working fluid which is contained in the first cylinder 32, to a desired temperature.

The working fluid, contained in the first cylinder 32, is liquid having a high thermal expansion coefficient. In the preferred embodiment of this invention, paraffin is preferably used as the working fluid of the cylinder 32 since paraffin quickly increases in volume when heated.

Two heaters 34 are externally installed around the first cylinder 32 at opposite side surfaces of said cylinder 32, and are used for heating the working fluid within the cylinder 32. Two electrically conductive terminals 35 are set on the opposite sidewalls of the first case 30 such that the terminals 35 are partially projected from the sidewalls of the case 30 and apply electricity from an electric power source to the heaters 34.

A first piston 33 is movably inserted into the first cylinder 32 which is seated in the cylinder seat opening 32*a* of the actuation rod 31. This piston 33 linearly extends from or retracts into the cylinder 32 in response to a volumetric change of the working fluid within the cylinder 32 to linearly reciprocate the actuation rod 31 relative to the cylinder 32.

A first biasing member 36, such as a coil spring, is set between the end of the actuation rod 31 and the first case 30, and holds the actuation rod 31 relative to the case 30 such that the biasing means 36 normally biases the actuation rod 31 in a direction.

A spring seat groove 36*a* is formed on each of the first case 30 and the actuation rod 31, and seats an associated end of the biasing means 36 therein so as to prevent undesired removal of the biasing means 36 from its place within the first case 30. Due to such a stable support for the biasing means 36 provided by the spring seat grooves 36*a*, it is possible to normally stably bias the actuation rod 31 in a desired direction.

When the heaters 34 are electrically activated, the working fluid within the first cylinder 32 is heated to increase its volume, thus making the first piston 33 extend from the cylinder 32 to a desired length. During such an extension of the first piston 33, the piston 33 comes into contact with the end of the actuation rod 31 and pushes the actuation rod 31 in the same direction. Therefore, the rod 31, connected to the connection bracket 6, is retracted.

The second case 40 is the important part of the drainage control device of this invention. As described above, the second cylinder 42 is set within the second case 40, and selectively receives the working fluid from the first cylinder 32 so as to control the flow direction and flow rate of the working fluid of the cylinder 32.

The first and second cylinders 32 and 42 are communicated together through a pipe 41.

The construction of the second case 40 will be described in detail below in conjunction with FIGS. 4 or 5.

The second cylinder 42 is set within the second case 40, and selectively receives the working fluid from the first cylinder 32 so as to control the flow rate of the working fluid within the first cylinder 32. A coil 44 is set between the second cylinder 42 and the second case 40 at a predetermined position. This coil 44 acts as an electromagnet when it is electrically heated by an electric conductive terminal 45 mounted to the second case 40.

The electric conductive terminal 45 is mounted to the second case 40 such that the terminal projects from the case 40 to a predetermined length. This terminal 45 is electrically activated by electricity from an electric power source, and heats the coil 44.

A second piston 43 is movably inserted into the second cylinder 42, and linearly moves relative to the cylinder 42 so as to quickly suck or expel the working fluid from or into the first cylinder 32. This second piston 43 is made of metal, and so it is electromagnetically operated in response to an electricity application to the coil 44. Therefore, the second piston 43 is electromagnetically controlled in its linear extension or retraction relative to the second cylinder 42.

The linearly reciprocable second piston 43 is stably supported by a second biasing member 45, such as a coil spring, which is set between one end of the second piston 43 and one end wall of the second cylinder 42. In such a case, the second biasing member 45 normally biases the second piston 43 in a direction.

When the coil 44 within the second cylinder 42 is electrically activated, a positive polarity is electromagnetically formed on the coil 44, thus attracting the second piston 43 having a negative polarity. Therefore, the working fluid flows from the first cylinder 32 into the second cylinder 42.

On the other hand, when the coil 44 is turned off, the coil 44 is restored to its original polarity, that is, negative polarity, and so the coil 44 repulses the second piston 43 having negative polarity. In such a case, the restoring force of the second biasing member 45 also pushes the second piston 43 in the same direction, thus allowing the second piston 43 to expel the working fluid from the second cylinder 42 into the first cylinder 32.

The operation of the drainage control device according to the preferred embodiment of the present invention will be described below with reference to FIGS. 5 and 6.

FIG. 5 is a plan view, showing an operation of the drainage control device 50 of this invention during a draining or dehydrating mode of the washing machine.

When the heaters 34 are electrically activated after a washing mode of the washing machine is finished, the working fluid within the first cylinder 32 is heated to increase in its volume. In such a case, the coil 44 is turned off at the same time, and so an existing magnetic field is removed from the coil 44. Therefore, the coil 44 releases the second piston 43 to allow the second piston 43 to be strongly biased by the restoring force of the second biasing member 45. The second piston 43 is thus pushed.

The working fluid is thus expelled from the second cylinder 42 into the first cylinder 32. Since the working fluid within the first cylinder 32 increases in its amount due to fluid flowing from the second cylinder 42, and increases in its volume due to the heating, the working fluid pushes the first piston 33 in the first cylinder 32. Therefore, the actuation rod 31 is pulled to open the drain port 4*a* and to pull the connection lever 7 of the power transmission lever 2 so as to perform draining and dehydrating modes.

Figure 6:
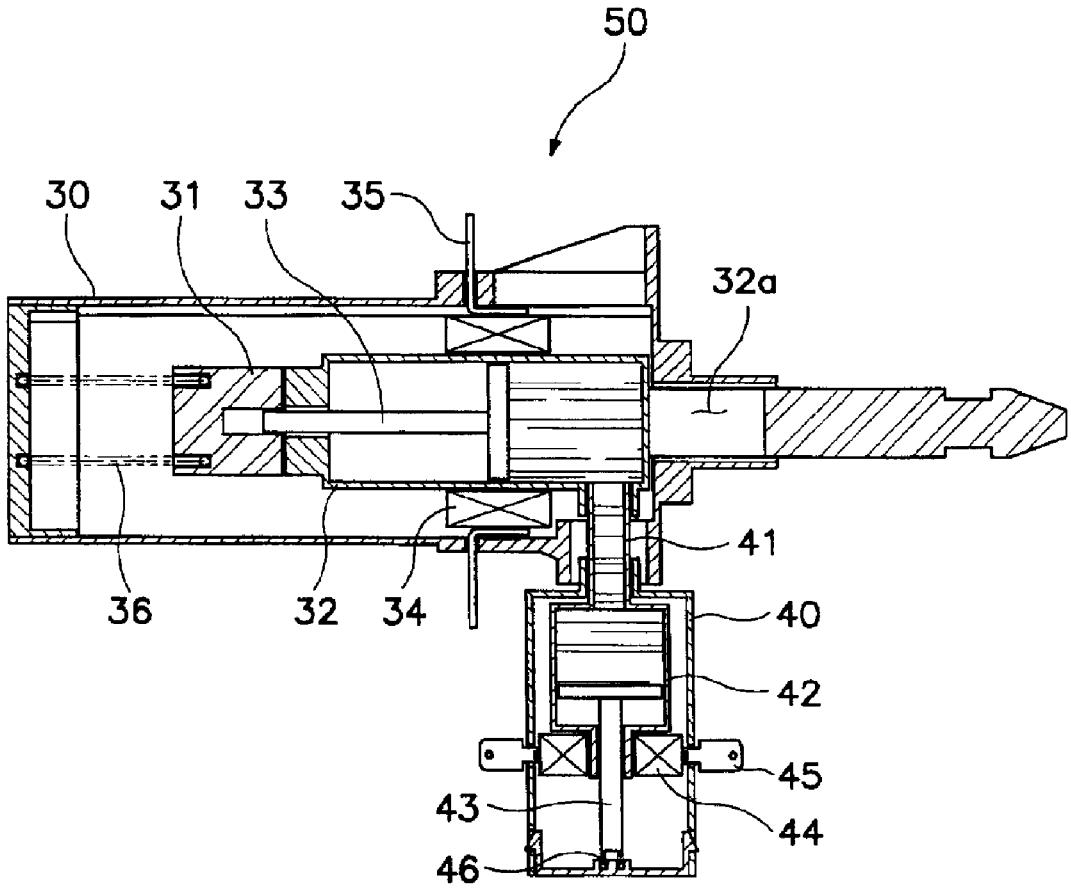
FIG. 6 is a plan view, showing an operation of the drainage control device of this invention during a washing mode of the washing machine.

FIG. 6 is a plan view, showing an operation of the drainage control device of this invention during water feeding and washing modes of the washing machine.

After the draining and dehydrating modes of the washing machine, the heaters 34 are turned off, thus allowing the working fluid within the first cylinder 32 to be cooled and reduced in its volume. However, the working fluid within the first cylinder 32 is not quickly cooled to a desired temperature. In order to allow the actuation rod 31 to quickly return to its original position, the coil 44 of the second cylinder 42 is electrically activated to pull the second piston 43.

Therefore, the working fluid is expelled from the first cylinder 32 into the second cylinder 42, and so the working fluid within the first cylinder 32 is reduced in its volume, with the first piston 33 returning to its original position. In such a case, the actuation rod 31 is biased by the first biasing member 36 to close the drain port 4*a* and to release the connection lever 7 of the power transmission unit 2. The brake band (not shown) of the power transmission unit 2 is released from the connection lever 7, thus stopping the rotation of the perforated spin tub (not shown).

As described above, the present invention provides a drainage control device for washing machines. This drainage control device is less likely to cause operational errors or operational noises regardless of long periods of use. This device also has a simple construction, a reduced number of parts, and is produced at low cost due to the simple construction.

Although a preferred embodiment of the present invention has been described for illustrative purposes, those skilled in the art will appreciate that various modifications, additions and substitutions are possible, without departing from the scope and spirit of the invention as disclosed in the accompanying claims. For example, the use of the drive device of this invention is not limited to the drainage control device for washing machines, but the drive device may be usable in a variety of machines without affecting the functioning of this invention.

What is claimed is:

1. A drainage control device for washing machines, comprising: first drive means containing a working fluid and operated in response to a change in volume according to expansion and retraction of said working fluid by a heater; and second drive means connected to said first drive means and controlling inflow and outflow of the working fluid relative to the first drive means, whereby the drainage control device controls drainage of water (a) by an extension of a first piston having an actuation rod connected at one end whereby the actuation rod is retracted so that drainage is open and (b) by a retraction of the first piston whereby the actuation rod is pushed out so that drainage is closed.

2. The drainage control device according to claim 1, wherein said first drive means comprises: a first cylinder containing the working fluid, within which the first piston reciprocates; and a heating means used for heating said first piston; and wherein the, actuation rod is operated in conjunction with both the first piston and the heating means to open or close a drain port.

3. The drainage control device according to claim 2, wherein said heating means is a heater-connected to an electrically conductive member electrically activated by a power source.

4. The drainage control device according to claim 2, wherein said actuation rod is normally biased by an elastically biasing member in a direction.

5. The drainage control device according to claim 1, wherein said second drive means comprises: a second cylinder communicating with said first cylinder so as to control flow rate of the working fluid within the first cylinder; a second piston reciprocating within said second cylinder; and control means for controlling movement of said second piston.

6. The drainage control device according to claim 5, wherein said control means is a coil connected to an electrically conductive member electrically activated by a power source.

* * * * *